US006176328B1

(12) United States Patent
Caraway et al.

(10) Patent No.: US 6,176,328 B1
(45) Date of Patent: Jan. 23, 2001

(54) DRILL PIPE PROTECTION RINGS AND METHOD OF USING THE SAME

(75) Inventors: Miles F. Caraway, Shreveport, LA (US); Douglas D. Hall, Houston, TX (US)

(73) Assignee: ABB Vetco Gray Inc., Houston, TX (US)

( * ) Notice: Under 35 U.S.C. 154(b), the term of this patent shall be extended for 0 days.

(21) Appl. No.: 09/363,126

(22) Filed: Jul. 28, 1999

Related U.S. Application Data

(60) Provisional application No. 60/095,003, filed on Jul. 30, 1998.

(51) Int. Cl.[7] ..... E21B 12/00

(52) U.S. Cl. ..... 175/325.5; 175/325.1; 175/320; 166/242.1

(58) Field of Search ..... 175/320, 325.1, 175/325.5; 166/242.1; 138/177, 178; 277/343, 336, 323, 648, 649, 641, 642

(56) References Cited

U.S. PATENT DOCUMENTS

| | | | | |
|---|---|---|---|---|
| 2,722,462 | * | 11/1955 | Tschirley | 175/325.5 |
| 2,886,291 | | 5/1959 | Frisby . | |
| 3,787,993 | | 1/1974 | Lyon . | |
| 4,618,828 | * | 10/1986 | Raynal | 175/50 X |
| 5,152,642 | | 10/1992 | Pitts et al. . | |
| 5,535,837 | | 7/1996 | Carlin . | |
| 5,819,851 | | 10/1998 | Dallas . | |

OTHER PUBLICATIONS

Petroleum Engineer, vol. 52, No. 3, Mar. 1980 "Recommended Practice for Mill Slot and Groove Method of Drill String Identification".

* cited by examiner

*Primary Examiner*—David Bagnell
*Assistant Examiner*—Sunil Singh
(74) *Attorney, Agent, or Firm*—Felsman, Bradley, Vaden, Gunter & Dillon, L.L.P.; James E. Bradley

(57) ABSTRACT

Drill pipe protection rings for filling external identification slots in drill pipe tool joints prevent damage to the internal seals of a drilling head. The rings are formed from resilient elastomeric materials. In cross-section, each ring has slightly convex inner and outer surfaces, and a series of circumferentially spaced-apart, hemispherical bumps located along its inner surface. One ring is mounted within each slot on each drill pipe section. The rings stretch slightly while being installed, but form a tight fit once they are properly seated. When installed, the outer surfaces of the rings will protrude slightly outward from or beyond the slots. The hemispherical bumps help align and center the rings within the slots. Without the rings, sharp edges of the slots on the drill pipe tool joints could cause severe damage as they passed through the drill head. However, with the rings, the outer surfaces of the slots are substantially filled to prevent their edges from cutting or gouging the elastomers.

17 Claims, 2 Drawing Sheets

DRILL PIPE PROTECTION RINGS AND METHOD OF USING THE SAME

CROSS-REFERENCE TO RELATED APPLICATIONS

This application claims the benefit of provisional application Ser. No. 60/095,003, filed on Jul. 30, 1998, in the United States Patent & Trademark Office.

TECHNICAL FIELD

This invention relates in general to drill pipe and in particular to drill pipe protection rings.

BACKGROUND OF THE INVENTION

During drilling, sections of drill pipe are secured together at their tool joints. The tool joints are the threaded connector portions of each section of pipe and have enlarged outer diameters at their connector portions. Certain types of high strength drill pipe, such as S-135 classification drill pipe, have one or more milled slots surrounding the outer diameter. The slots are circumferential, concave grooves which merely designate the material of the drill pipe and do not serve any other function. The slots have a variety of sizes, but are approximately ⅜ inch deep and ½ inch wide. Each slot has relatively sharp upper and lower corner edges and a curved base.

In one type of drilling, the drill pipe passes through a drilling head located at the drilling rig. The drilling head has a rotatable section that grips and seals around the drill pipe. When run through the drilling head, the sharp edges of the slots can severely damage the gripping and sealing members located inside the drilling head. Thus, an apparatus and/or method for reducing damage to the drilling head is needed.

SUMMARY OF THE INVENTION

Drill pipe protection rings for filling the external slots in drill pipe are disclosed. The rings are formed from resilient elastomeric materials. In cross-section, each ring has slightly convex inner and outer surfaces, and a series of circumferentially spaced-apart, hemispherical bumps located along its inner surface.

One ring is mounted within each slot on each drill pipe section. The rings stretch slightly while being installed, but form a tight fit once they are properly seated. When installed, the outer surfaces of the rings will protrude slightly outward from or beyond the slots. The hemispherical bumps help align and center the rings within the slots. Without the rings, the sharp edges of the slots on the drill pipes would cause severe damage as they passed through the drill head. However, with the rings the outer surfaces the slots are substantially filled to prevent their edges from cutting or gouging the elastomers.

BRIEF DESCRIPTION OF DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

BEST MODE FOR CARRYING OUT THE INVENTION

Figure 1:
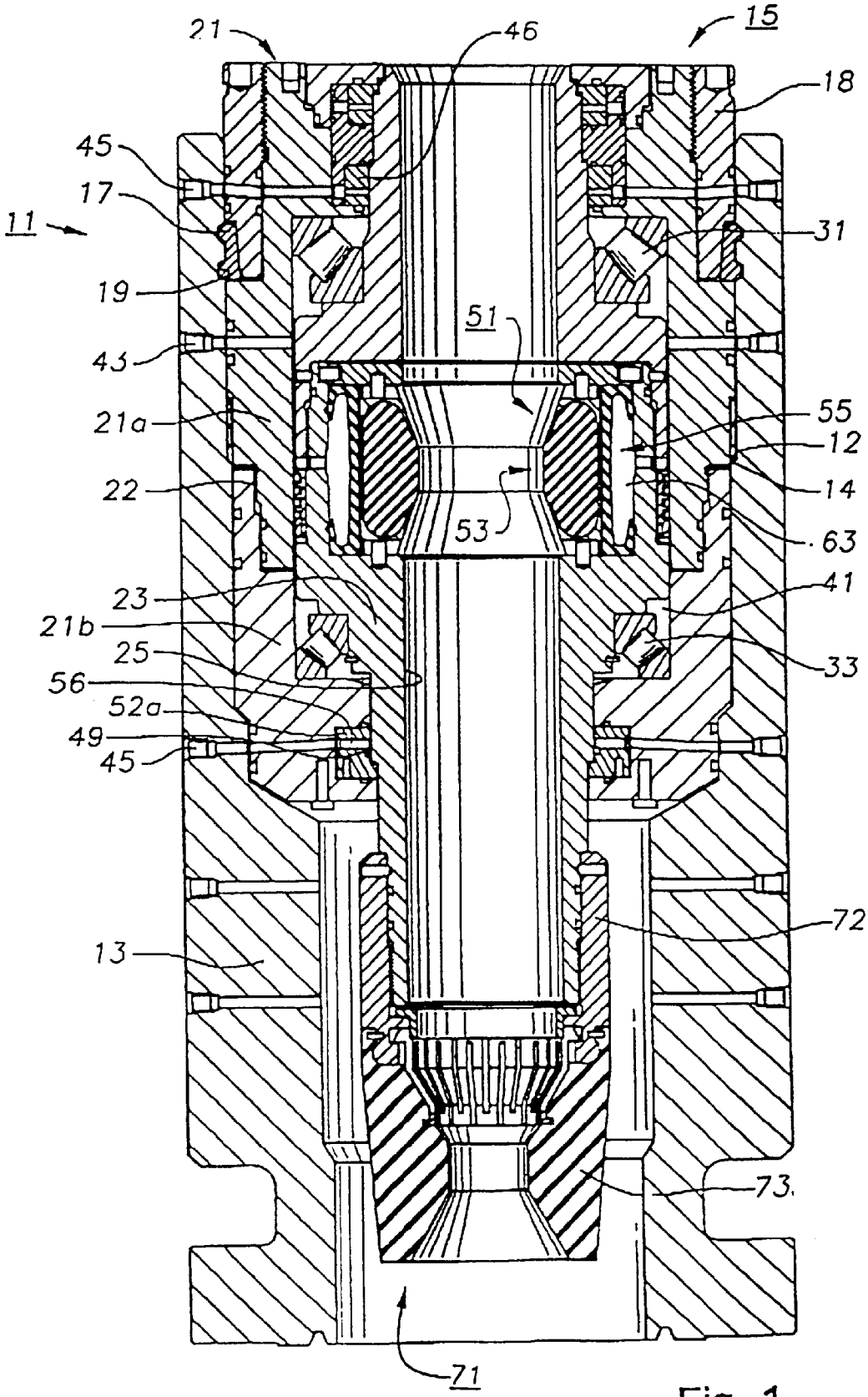
FIG. 1 is a sectional side view of one type of a drilling head for receiving drilling pipe.

Referring to FIG. 1, a drilling head 11 has a body assembly 15 with a lower shoulder 12 that lands on an upward facing shoulder 14 in an external housing 13. Body assembly 15 is removably secured to housing 13 with an annular split ring or locking member 17. When a cam member 18 is rotated downward relative to body assembly 15, locking member 17 is forced radially outward and seats in a groove 19 in housing 13 to lock body assembly 15 from upward movement.

Body assembly 15 comprises an outer body 21 having an upper portion 21*a* and a lower portion 21*b* which are secured to one another at threads 22. Body assembly 15 also has a rotor or inner body 23 with an axial bore 25. Inner body 23 is rotatable relative to stationary outer body 21 on upper bearings 31 and lower bearings 33.

An annulus 41 extends between outer body 21 and an upper portion of inner body 23. A pair of inlet ports 43 and three outlet ports 45 communicate hydraulic fluid with annulus 41. Annulus 41 is sealed on an upper side by seal 46 and on a lower side by seal 49 which slidingly engage inner body 23. In the preferred embodiment, seal 46 is a carder containing a dynamic rotating seal.

Inner body 23 has a centrally located packer or gripping member 51 with an inner portion 53 and an outer portion 55. Inner portion 53 comprises a solid annular elastomer which is supported by rigid segments. Inner portion 53 is free to move radially relative to inner body 23 between energized and unenergized states. The outer diameter of inner portion 53 abuts the inner diameter of outer portion 55. Outer portion 55 comprises a channel or annular elastomer with an annular cavity 63 which communicates with annulus 41.

A primary seal 71 extends from a lower end of inner body 23 and is spaced axially apart from gripping member 51. Seal 71 has a tubular member 72 which threadingly engages an outer portion of inner body 23. Seal 71 also comprises an elastomer 73 which has an axial passage and a frustoconical exterior. The internal diameter of elastomer 73 is smaller than the diameter of bore 25, gripping member 51, and the outer diameter of drill pipe. Seal 71 provides the primary seal for sealing drilling head 11 against the drill pipe. Gripping member 51 causes seal 71 to rotate with the drill pipe and provides an auxiliary or secondary seal for sealing drilling head 11 against the drill pipe.

Figure 3:
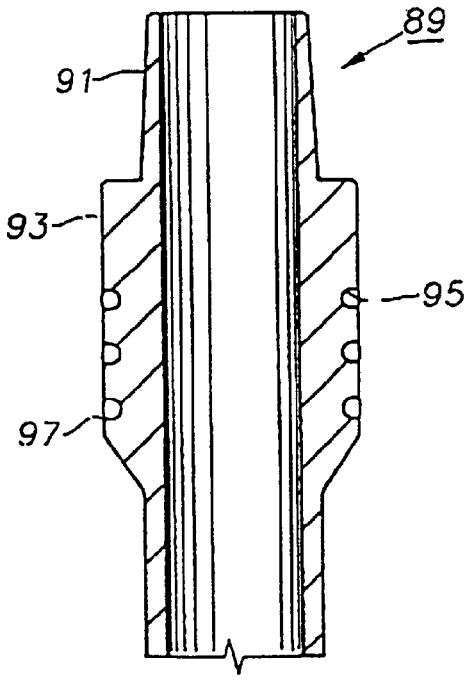
FIG. 3 is a sectional side view of an end of a drill pipe.

FIG. 3 shows a portion of a type of drill pipe 89 that may be run through drilling head 11. Sections of drill pipe 89 are secured together by tool joints 91. Tool joints 91 are the threaded connector portions of each section of pipe 89 and have enlarged outer diameters 93 at their connector portions. Certain types of high strength drill pipe 89, such as S-135 classification drill pipe, have one or more milled slots 95 surrounding their outer diameters 93. Slots 95 are circumferential, concave grooves which designate the material of drill pipe 89. Slots 95 do not serve any function other than identifying the type of pipe. Slots 95 have a variety of sizes, but are approximately ⅜ inch deep and ½ inch wide. The tolerances for slots 95 are not close. Each slot 95 has relatively sharp upper and lower corner edges 97 and a curved base. Slots 95 can be detrimental to the gripping member 51 and sealing member 73 of drilling head 15.

Figure 2:
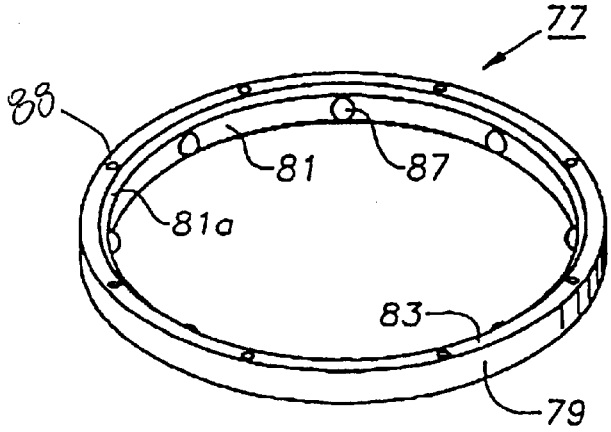
FIG. 2 is an isometric view of a drill pipe protection ring constructed in accordance with the invention.

Referring now to FIG. 2, a drill pipe protection ring 77 for filling slots 95 is shown. Ring 77 is formed from a resilient elastomeric material such as 85 Durometer urethane compound. As shown by the cross-sectional view of FIG. 4, ring 77 has a slightly convex outer surface 79, a convex inner surface 81, and flat upper and lower surfaces 83, 85. Inner surface 81 is given its convex shape with upper and lower chamfers 81*a*. In the embodiment shown, outer surface 79 has two flat surfaces that join each other at a crest or peak. Ring 77 also has a plurality of circumferentially spaced-apart, hemispherical bumps 87 located along a midline of inner surface 81. The space between on inner surface 81 between the bumps 87 are flat in cross-section. Ring 77 has small protruding bumps 88 spaced apart from each other on the upper and lower surfaces 83, 85.

Figure 4:
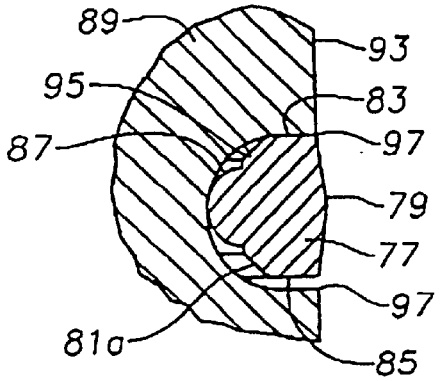
FIG. 4 is a partial sectional side view of a portion of the drill pipe of FIG. 3 fitted with the drill pipe protection ring of FIG. 2.
Figure 5:
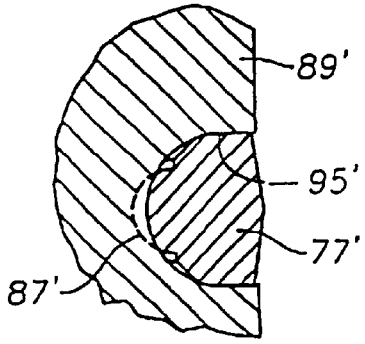
FIG. 5 is a partial sectional side view of a portion of the drill pipe similar to FIG. 3, but showing a slot with a shallower depth.

In operation (FIG. 5), one ring 77 is located within each slot 95 on pipe 89. The elastomeric material of rings 77 stretches slightly to increase their diameter while being fitted around outer diameter 93 of tool joint 91. Rings 77 snap into slots 95 for a tight fit once they are properly seated. Rings 77 have a width and thickness which substantially fills slots 95. When installed, outer surfaces 79 of rings 77 will protrude slightly outward from or beyond slots 95. In FIG. 4, slot 95 is slightly wider than ring 77. Bumps 87 help align and center ring 77 with a slot 95. In FIG. 5, slot 95' has a shallower depth than the radial dimension of ring 77', as indicated by dashed line bump 87'. In these instances, bumps 87' deform slightly (not shown) so that ring 77' will fit substantially flush with and only protrude slightly from the slot 95'. Small bumps 88 (FIG. 2) on the top and bottom faces 83, 85 of ring 77 serve to vertically centralize ring 77 in oversized slots 95. In close-fitting slots 95, the top and bottom face bumps 88 would shear off during installation to allow a snug fit and good retention within slot 95.

With rings 77 in place, a string of drill pipe 89 is lowered through bore 25 of drill head 11 (not shown). Bore 25 is large enough to permit the enlarged diameter 93 of tool joints 91 to pass through. When tool joints 91 are lowered through seal 71, elastomer 73 flexes radially outward as the tool joint 91 passes through seal 71. As the tool joint 91 exits seal 71, seal 71 contracts back to its original shape and seals around the drill pipe.

If rings 77 were not installed, the sharp corner edges 97 of each slot 95 on pipe 89 may cause severe damage to the elastomers in drill head 11 as pipe 89 passed through them. However, the outer surfaces 79 of rings 77 are substantially flush with the outer surface 93 of tool joint 91, thereby preventing edges 97 from cutting or gouging the elastomers.

After installation and during drilling, gripping member 51 is energized to grip and provide a secondary seal around drill pipe 89, thereby causing body 23 to rotate with drill pipe 89. In its unenergized state, the inner diameter of inner portion 53 is greater than the diameter of drill pipe 89 but slightly smaller than the diameter 93 of tool joints 91. In an energized state, the inner diameter of inner portion 53 is smaller than the diameter of drill pipe 89. This is done by pumping hydraulic fluid through inlet ports 43. As the hydraulic fluid circulates through annulus 41 and out outlet ports 45, bearings 31, 33, upper seal 46 and lower seal 49 are simultaneously lubricated by the hydraulic fluid. The hydraulic fluid also enters cavity 63. This pressure energizes gripping member 51 by pressing radially inward against outer portion 55 which exerts pressure against inner portion 53.

The invention has several advantages. The rings reduce the chance for slots in the tool joints to cut the elastomers of a drilling head. The bumps on the inner surfaces of the rings help align and center them within the slots in the drill pipe. Without the rings, the sharp edges of the slots on the drill pipes may cause severe damage as they passed through the drill head. However, with the rings the outer surfaces the slots are substantially filled to prevent their edges from cutting or gouging the elastomeric members inside the drill head.

While the invention has been shown or described in only some of its forms, it should be apparent to those skilled in the art that it is not so limited, but is susceptible to various changes without departing from the scope of the invention.

We claim:

1. A well drilling string for use in drilling with a drill head that seals around the drill pipe during drilling, comprising:

a plurality of sections of drill pipe secured together at tool joints, each of the tool joints having a larger outer diameter than an outer diameter of the pipe, at least some of the tool joints having at least one external, circumferential, identification groove, each of the grooves having a substantially smaller axial dimension than an axial length of each of the tool joints;

a plurality of rings, each of the rings located within one of the grooves to avoid damaging sealing members located within the drill head.

2. The well drilling string of claim 1 wherein each of the rings has an outer diameter surface that is substantially flush with an exterior surface of the tool joint.

3. The well drilling string of claim 1 wherein each of the rings has a top face, a bottom face, and a generally convex inner diameter when viewed in a cross-section taken parallel to an axis of each of the rings.

4. The well drilling string of claim 1, wherein each of the grooves has a concave base, and wherein each of the rings further comprises a convex protrusion on an inner diameter surface of each of the rings.

5. The well drilling string of claim 1 wherein each of the rings has an inner surface, a top face, and a bottom face, and wherein the inner surface is chamfered where it interfaces the top and bottom faces.

6. The well drilling string of claim 1 wherein each of the rings has top and bottom faces that are substantially flat.

7. The well drilling string of claim 1, wherein each of the rings is formed from a urethane compound.

8. The well drilling string of claim 1 wherein said at least one groove comprises a plurality of external, circumferential, identification grooves located on each of the tool joints, and wherein the rings are located within said plurality of grooves.

9. The well drilling string of claim 1 wherein each of the grooves is about ½ inch wide and each of the rings is about ½ inch wide.

10. The well drilling sting of claim 1 wherein each of the grooves has a base that is generally concave when viewed in a cross-section parallel to an axis of its respective tool joint, and each of the rings has an inner diameter that is convex.

11. The well drilling string of claim 1, wherein each of the grooves has a base that when viewed in a cross-section transverse to an axis of its respective tool joint, is at a single radius.

12. An apparatus for use with a sting of drill pipes, each of the drill pipes having a tool joint formed thereon with at least one external, circumferential, identification groove formed on an outer diameter, each of the grooves having a concave base, the apparatus comprising:

an annular member having a top face, a bottom face, and inner and outer diameter surfaces;

the inner diameter surface of the annular member being convex when viewed in a plane parallel with an axis of the annular member; and wherein the annular member is adapted to seat in one of the grooves in one of the tool joints for substantially filling said groove to create a substantially flush outer surface in the tool joint at said groove.

13. The apparatus of claim 12 wherein the top and bottom faces are substantially flat.

14. The apparatus of claim 12 wherein the annular member is about ½ inch wide.

15. The apparatus of claim 12 wherein the annular is formed from a urethane compound.

16. A method for protecting an elastomeric seal of a rotating drilling head that seals around a string of drill pipes having a plurality of tool joints with at least one external, circumferential, identification groove on an outer diameter thereof, the method comprising:

(a) providing an annular member for each of the grooves; and (b) seating the annular members in the grooves in the tool joints to substantially fill said grooves and create a substantially flush outer surface in the tool joints at said grooves.

17. The method of claim 16, wherein step (b) further comprises aligning and centering the annular members in said grooves with protrusions on inner diameter surfaces of the annular members.

* * * * *

UNITED STATES PATENT AND TRADEMARK OFFICE

CERTIFICATE OF CORRECTION

PATENT NO. : 6,176,328 B1
DATED : January 23, 2001
INVENTOR(S) : Miles F. Caraway, and Douglas D. Hall It is certified that error appears in the above-identified patent and that said Letters Patent is hereby corrected as shown below:

Column 4, claim 10,
Delete "sting" and substitute therefor -- string --

Column 5, claim 12,
Delete "sting" and substitute therefor -- string --

Signed and Sealed this

Twenty-first Day of August, 2001

*Attest:*

Nicholas P. Godici

NICHOLAS P. GODICI
*Acting Director of the United States Patent and Trademark Office*

*Attesting Officer*